US006585327B2

(12) United States Patent
Sollami

(10) Patent No.: US 6,585,327 B2
(45) Date of Patent: Jul. 1, 2003

(54) TOOL MOUNTING ASSEMBLY WITH TUNGSTEN CARBIDE INSERT

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 10/075,081

(22) Filed: Feb. 13, 2002

(65) Prior Publication Data

US 2002/0070602 A1 Jun. 13, 2002

Related U.S. Application Data

(63) Continuation of application No. 09/505,088, filed on Feb. 16, 2000, now Pat. No. 6,357,832, which is a continuation-in-part of application No. 09/121,726, filed on Jul. 24, 1998, now Pat. No. 6,164,728.

(51) Int. Cl.[7] ..... E21C 35/18
(52) U.S. Cl. ..... 299/107; 299/106; 299/104
(58) Field of Search ..... 299/102–107, 299/110–111, 113; D15/21

(56) References Cited

U.S. PATENT DOCUMENTS

| | | | | |
|---|---|---|---|---|
| 3,268,260 A | * | 8/1966 | Snipe | 299/107 |
| 3,512,838 A | * | 5/1970 | Kniff | 299/104 |
| 3,992,061 A | | 11/1976 | Rollins | |
| 4,201,421 A | | 5/1980 | Den Besten et al. | |
| 4,302,055 A | * | 11/1981 | Persson | 299/102 |
| 4,763,956 A | | 8/1988 | Emmerich | |
| 4,844,550 A | * | 7/1989 | Beebe | 299/107 |
| 4,915,455 A | | 4/1990 | O'Neill | |
| 5,415,462 A | * | 5/1995 | Massa | 299/106 |
| 5,498,069 A | * | 3/1996 | Siebenhofer et al. | 299/106 |
| 5,503,463 A | | 4/1996 | Ojanen | |
| 5,551,760 A | | 9/1996 | Sollami | |
| 5,884,979 A | | 3/1999 | Latham | |
| 5,931,542 A | | 8/1999 | Britzke | |
| 2002/0074851 A1 | * | 6/2002 | Montgomery, Jr. | 299/107 |

FOREIGN PATENT DOCUMENTS

| | | | |
|---|---|---|---|
| DE | 4202961 | * | 8/1993 |
| GB | 219438 A | | 6/1982 |

* cited by examiner

*Primary Examiner*—Heather Shackelford
*Assistant Examiner*—Sunil Singh
(74) *Attorney, Agent, or Firm*—Robert L. Marsh

(57) ABSTRACT

A tool mounting block has a body with a forward surface, and a cylindrical bore extending into the body perpendicular to the forward surface. A frustoconical countersink extends around the opening of the bore into the forward surface and a tungsten carbide collar is fitted into the countersink. In another embodiment the forward surface of the mounting block has at least one radial groove extending to an outer wall thereof.

8 Claims, 6 Drawing Sheets

TOOL MOUNTING ASSEMBLY WITH TUNGSTEN CARBIDE INSERT

This is a continuation of my application filed Feb. 16, 2000 and assigned Ser. No. 09/505,088, now U.S Pat. No. 6,357,832 B1 which in turn was a continuation in part of my application filed Jul. 24, 1998 assigned Ser. No. 09/121,726, now U.S. Pat. No. 6,164,728 B1. The present invention relates to rotatable mountings for cutting tools and, in particular, to rotatable mountings for cutting tools used for cutting hard surfaces and having tungsten carbide tips.

BACKGROUND OF THE INVENTION

Machines are available for cutting hard surface such as concrete and asphalt. To cut such hard surfaces, a wheel is rotated about its axis and cutting tools mounted on the wheel are applied against the surface and each tool removes a small portion of hardened material thereby advancing the cut.

To maximize the useful life of such cutting tools, the tools are rotatably mounted about a longitudinal axis and have a cylindrical mounting portion rotatably fitted into a cylindrical aperture on a mounting block. Force is applied from the mounting block on the wheel against a rearward surface of an annular flange on the tool which rests upon a forward surface of the mounting block.

The body of the tool to which the tungsten carbide cutting tip is attached and the tool mounting block into which the cylindrical mounting portion of the tool is fitted are made of cold formed or forged steel which is much softer than the tungsten carbide cutting tip. As the machine cuts hard surfaces such as asphalt or concrete, fragments of the broken surface are forced across the tapered forward portion of the tool and around the forward and side portions of the mounting block causing wear or wash away of the material which makes up both the tool body and the mounting block. After a substantial portion of the forward end of the tool has been worn away, the tool must be replaced. Similarly, after a substantial portion of the body of the mounting block has been washed away, the tool mounting block must also be replaced.

The rotation of the tool within the block occurs as a result of an uneven application of forces against the tool as it is applied to the hardened surface and, therefore, the mated annular surfaces on the block and on the tool, which transfer force from the block to the tool, also serves as a bearing surface for the rotation of the tool within the block. Over a period of time, particles of hardened material broken up by the tool work along the forward surface of the mounting block and under the rearward surface of the flange causing the mated surfaces to become irregular and thereby increasing the friction between the surfaces. The increased friction reduces the rotatability of the tool within the block. A tool which does not rotate within the mounting block will wear unevenly, thereby substantially reducing its useful life.

In recent years, the annular flanges behind the forward cutting ends of tools have been made larger in diameter to provide protection to the mounting block such that the portion of the body of the mounting block behind the flange will remain intact much longer than the body of the tool retained therein. As many as one hundred tools or more may be worn out before a mounting block suffers such wear that it must be replaced.

Although the presence of the enlarged flange on such tools protects portions of the body of such mounting blocks against wash away, particles of hardened material nonetheless work their way between the abutting surfaces of the mounting block and the tool and cause the forward surfaces of the mounting block and the inner surface of the cylindrical aperture extending through the mounting block to become worn. As a result of the wear on these two surfaces, a replacement tool inserted in the mounting block will not be snugly retained in the aperture, nor will the replacement tool rotate freely therein. When a replacement tool is inserted into a mounting block having a worn bore, the replacement tool will have a useful life which is much shorter than that of the original tool.

The flange of the tool which protects the mounting block from wash away also causes wear to the forward surface of the mounting block. After a number of tools have become worn out in a mounting block, the friction between the rear surface of the flange and the forward surface of the mounting block will cause a counterbore to be worn in the forward surface of the mounting block. When a new replacement tool is inserted into a mounting block which already has a counterbore worn by the flanges of prior tools, the flange of the replacement tool can bind against the inner circumference of the wall of the counterbore and prevent rotation of the replacement tool, which will lead to the premature failure of the tool.

It would be desirable, therefore, to provide a mounting block for which the critical surfaces which permits a tool to rotate in the bore will be resistant to wear to thereby further extend the useful life of the mounting block.

Efforts have been made to provide a tungsten carbide wear ring at the forward end of a mounting block as shown by Mills, U.S. Pat. No. 4,932,723. Efforts have also been made to protect the bore of a mounting block against excessive wear as shown by Kniff, U.S. Pat. No. 3,512,838. These efforts, however, have been less than successful for a number of reasons. First, tungsten carbide, which is the most desirable material for use in such inserts, is extremely brittle much like glass and easily fractures. Fracturing can occur for any of a number of reasons, one of which is expansion and contraction. The tools and mounting blocks of a cutting machine become extremely hot while in use (up to 600° F.) and the parts are continuously sprayed with water to prevent over heating and to suppress dust. As a result, the tools and mounting blocks are alternately heated as the tool cuts into hard material and cooled as the wheel rotates around from the end of one cut to the beginning of the next. The coefficient of expansion for tungsten carbide (0.00000239 per unit length/° F.) is approximately one third that of the coefficient of expansion for cast or wrought iron (0.00000661 per unit length/° F.), and the alternate heating and cooling of the brazed parts causes internal stresses within the tungsten carbide. The internal stresses can cause microscopic fractures to occur within the tungsten carbide and the microscopic fractures will lead to the rapid deterioration of the part. To prevent such microscopic deterioration, a tungsten carbide wear ring should have a minimum thickness of at least ⅛ inch and should be encased in braze material so that only the contact wear surface is exposed.

It is not practical to make a tungsten carbide part having both a cylindrical portion which would fit within a bore of a tool and a wear ring flange because internal stresses would always lead to failure of the part at the junction between the cylindrical portion and the flange portion.

Another problem which has lead to the failure of prior tungsten carbide inserts arises from the difficulty of brazing the parts together. Irregularly shaped parts such as those having both a cylindrical portion and a flange portion do not retain liquefied braze material between the parts during the brazing and as a result, portions thereof, such as the flange, will fracture off the mounting block because it is not adequately retained by braze material. If the wear ring is not encased in metal the tungsten carbide will be gradually chipped away as a result of impacts with pieces of hard material loosened by the tool as it cuts, thereby shortening the life of the mounting block the ring was intended to protect.

Another problem with a tungsten carbide wear ring is caused by wash away. The flange of the tool bodies protects a portion of the mounting block from wash away, but the portions of the block which extend beyond the outer diameter of the flange are still washed away over time. Since the wear ring must have a diameter approximately equal to the diameter of the flange, the metal encasing the outer circumference of the wear ring, which is unprotected by the flange, will be gradually washed away leaving the ring exposed and subject to being chipped away as described above.

It would be desirable to provide an improved insert which could protect the surfaces of a mounting block from becoming prematurely worn but would not be subject to fracturing. It would also be desirable to provide an insert which would more readily retain brazing material between the parts during the brazing operation.

SUMMARY OF THE INVENTION

Briefly, the present invention is embodied in a tool mounting block having a forward surface and an attachment portion whereby the mounting block is attachable to a cutting machine. The tool block has a forward surface and an aperture extending through the body of the block and an opening in the forward surface. A countersink is provided in the forward surface around the aperture and an annular insert is fitted within the countersink.

The annular insert has a central opening axially aligned with the axis of the cylindrical aperture in the mounting block and has a planar forward surface which is forwardly offset with respect to the forward surface of the mounting block. The insert further has a frustoconical outer wall and a planar rearward surface which is parallel to the forward surface. In the preferred embodiment, the annular insert is made of tungsten carbide and is bonded into the countersink in the mounting block with a suitable bonding material such as a braze.

A tool having a generally tapered body with a forward cutting end and a tungsten carbide tip at the forward end thereof and has an annular flange positioned rearward of the tapered body and a cylindrical mounting portion axially aligned behind the forward cutting end of the flange. The cylindrical mounting portion of the tool is rotatably fitted into the cylindrical aperture of the mounting block to permit rotation of the tool. Since the tungsten carbide insert is forwardly offset a short distance above the forward surface of the block, the rearward surface of the bit rotates on the forward surface of the insert and does not cause wear to the metal of the block body.

The tungsten carbide of the annular insert is much harder than the steel from which the body of the tool is made and, therefore, the steel of the tool becomes worn away by particles of hard material which work their way between the abutting surfaces of the annular insert and the tool while the surfaces of the tungsten carbide insert suffer very little wear. Typically, the steel of the tool wears away approximately ten times faster than the tungsten carbide of the insert is worn away.

After a tool mounted in such a block has become worn, the tool can be removed and the forward surface of the tungsten carbide annular insert will not be gouged or damaged so as to cause a substantial increase in the resistance to rotation when a new tool is inserted into the block. Similarly, the cylindrical inner surface of the bore of the annular insert will not have become worn away as a result of particles of hardened material working their way between the parts and when the cylindrical mounting portion of a replacement tool is inserted there, it will be snugly retained therein. In addition to the above, the coefficient of friction between two surfaces where one is steel and one is tungsten carbide is less than the coefficient of friction between two surfaces where both are steel. As a result, the useful life of the mounting block is extended and it can be expected to not require replacing until well over a hundred tools have become worn out.

In another embodiment of the invention, the aperture into which the tool is received extends to a rear surface of the mounting block and a counter bore is provided in the rear surface around the aperture. A second annular insert of tungsten carbide is provided in the counter bore in the rear surface such that a tungsten carbide ring is provided around both the forward and rearward ends of the aperture to ensure that both ends thereof are wear resistant.

BRIEF DESCRIPTION OF THE DRAWINGS

A better and more complete understanding of the present invention will be had after a reading of the following detailed description taken in conjunction with the drawings where.

DETAIL DESCRIPTION OF THE PREFERRED EMBODIMENT

Figure 1:
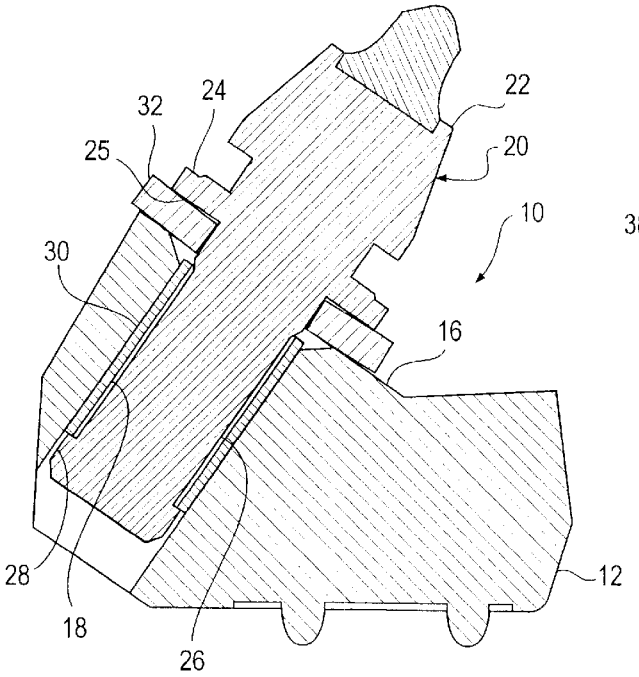
Fig. 1 PRIOR ART
FIG. 1 is a cross sectional view of a mounting block and tool in accordance with one embodiment of the prior art.

Referring to FIG. 1, a tool mounting block 10 in accordance with the prior art has a body 12 with a base portion 14 attachable to a machine, not shown, and a forward surface 16. Extending through the body 12 is a bore 18 having an opening in the forward surface 16.

Retained in the bore 18 of the block 10 is a tool 20 having a tapered forward cutting end 22. Positioned axially behind the forward cutting end 22 is a radial flange 24 having a rear surface 25, and axially behind the radial flange 24 is a cylindrical shank 26 at the distal end of which is a cylindrical hub 28 having a diameter a little greater than that of the shank 26. The shank 26 is retained in the bore 18 by a spring retainer 30.

During use, the tool 20 rotates within the bore 18 as the forward cutting end 22 thereof is forced against a hard surface to be cut. During heavy use of the machine, the tools 20 will become worn out and require replacement every day. When the rear surface 25 of the flange 24 is in direct contact with the forward surface 16 of the block 12, rotation of the tool 20 will, over a period of time, wear a counterbore in the forward surface 16 of the block 10. When a counterbore becomes worn in the forward surface 16 of the block, the outer circumference of the flange 24 can bind against the walls of the counterbore, thereby inhibiting rotation of the tool and causing the tool to become worn out prematurely.

During use of the machine, fine particles broken loose by the tool 20 also work their way under the flange 24 and along the forward surface 16 until they fall into the bore 18 and between the inner surface of the retainer 30 and the shank 26. As particles accumulate between the surfaces of the shank 26 and the inner surface of the retainer 30 they inhibit rotation of the tool. Gradually the bore of a block becomes worn, after which it is necessary to replace a tool block 10.

To prevent the flanges 24 of the tool 20 from wearing a counterbore in the forward surface 16 of the block 10, a washer 32 of hardened steel is fitted around the shank 26 of the tool between the rear surface 25 of the flange 24 and the forward surface 16 of the block 10. Since the flange 24 rotates and the washer 32 remains stationary, it is the washer 32 which becomes worn rather than the forward surface 16 of the block 10. Each time a worn tool 20 is replaced, the worn washer 32 is also replaced.

Although the washer 32 prevents the wearing of a counterbore in the forward surface 16 of the tool body 10, it does not prevent particles of hard material from being worked under the flange 24 until they fall between the shank 26 and the inner surface of the retainer 30. In fact, the provision of the washer 32 renders the bore 18 more susceptible to becoming worn from small particles because the particles can work under both the flange 24 and the washer 32.

Figure 2:
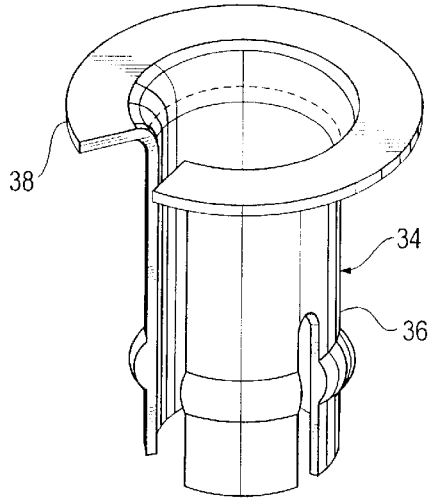
Fig. 2 PRIOR ART
FIG. 2 is an isometric view of a unitary retainer and washer in accordance with a second embodiment of the prior art.

Referring to FIG. 2, in another embodiment of the prior art, the retainer 30 and the washer 32 are formed as a single part 34 having a cylindrical retainer portion 36 and at the forward end of the retainer portion 36 a radial flange 38. Like the washer 32 and the retainer 30, the part 34 is replaced when the worn tool 20 is replaced. The part 34 is, however, subject to the same limitation discussed with respect to the washer 32 and retainer 30.

Prior efforts to provide a tungsten carbide sleeve within the bore 18, such as proposed by Kniff in U.S. Pat. No. 3,512,838, have also been unsuccessful. Tungsten carbide is very brittle and expensive to manufacture. To withstand the stresses incurred in a machine for cutting hard surfaces without shattering a tungsten carbide sleeve which extends through the length of this bore, as is disclosed by Kniff, must have a thick wall and would be prohibitively expensive to manufacture.

Figure 3:
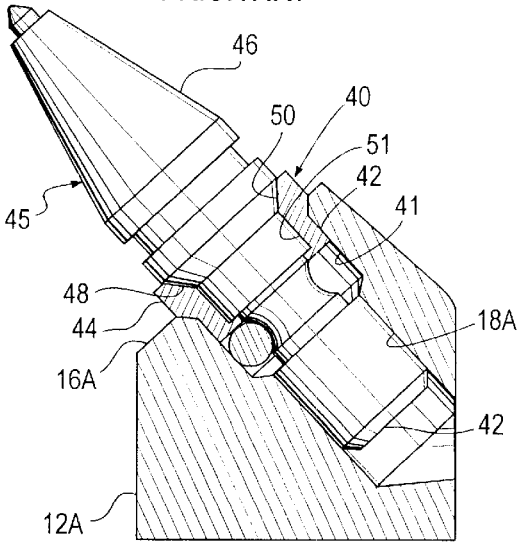
Fig. 3 PRIOR ART
FIG. 3 is a cross sectional view of a mounting block and tool in accordance with a third embodiment of the prior art.

Referring to FIG. 3, in U.S. Pat. No. 3,512,838, Kniff also proposed that a sleeve 40 be fitted in a counter bore 41 around the bore 18A of the tool body 12A. As shown, the sleeve 40 has a cylindrically shaped rear portion 42 and a flared forward portion 44. The tool 45 of Kniff is disclosed as having a tapered forward end 46 which widens to a diameter which is a little greater than that of the central opening of the sleeve 40. A frustoconical portion 48 of the tool body 45 abuts a complementarily shaped frustoconical portion 50.of the central opening 51 of the sleeve to bear the thrust loads incurred as the tool cuts a hard surface.

It is believed that the carbide sleeve 40 disclosed by Kniff has never been used in commerce. Like the sleeve which extended the length of the bore, the walls of the sleeve 40 must have a substantial thickness to withstand the stresses of the machine without shattering. The tungsten carbide sleeve as disclosed by Kniff projects a substantial distance beyond the forward surface 16A of the mounting black 10, and such a projection of tungsten carbide would be rapidly chipped away as a result of impacts with chunks of hard material loosened by the tool 45. Furthermore, the sleeve 40 cannot be adapted to accept a tool of the type presently in use having a flange to protect the forward surface of a mounting block.

Figure 4:
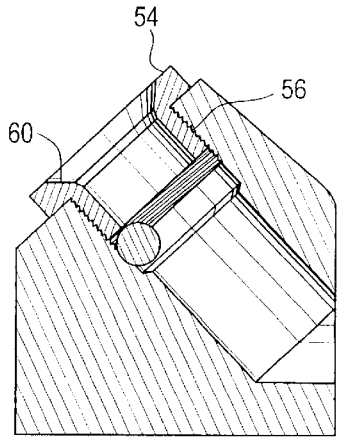
Fig. 4 PRIOR ART
FIG. 4 is a cross sectional view of a mounting block in accordance with a fourth embodiment of the prior art.

Referring to FIG. 4, in U.S. Pat. No. 3,512,838, Kniff also disclosed a unitary piece 54 having a cylindrical portion 56 fitted into a threaded bore 58 in the mounting block 10, and a radial flange 60 at the forward end of the cylindrical portion 56. The unitary piece 54 could not be manufactured of tungsten carbide because it is too brittle, and would readily fracture where the flange 60 joins the cylindrical portion 56. Also, like the embodiment shown in FIG. 3, a flange 60 made of tungsten carbide will be rapidly chipped away by chucks of hard material loosened by the machine. The unitary piece 54 is disclosed as being made of hard steel and when made of steel this embodiment is substantially the same as the embodiment shown in FIG. 2.

Figure 4A:
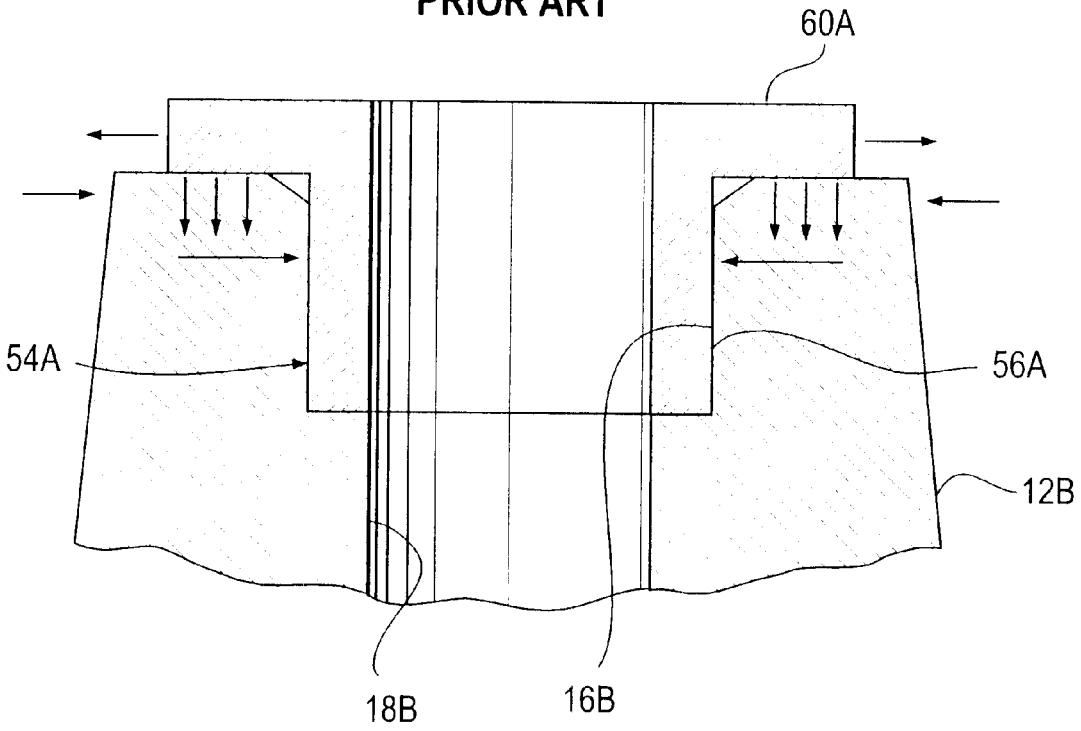
Fig. 4A PRIOR ART
FIG. 4A is a cross sectional view of a of a unitary prior art retainer and washer similar to the embodiment shown if FIG. 4 depicting the forces applied thereto when the part is brazed to a mounting block.

There are other reasons why a unitary piece such as part 54 cannot be made from tungsten carbide. As can be seen in FIG. 4A, when a part 54A having a tubular portion 56A and a flange portion 60A is brazed to a mounting block 12B and the tubular portion 56A is brazed into a counterbore 16B, the parts expand and contract. The parts expand as they are heated to above 1800 degrees fahrenheit to melt the braze material, then they contract as they cool. The braze hardens as the parts cool below 1600 degrees fahrenheit, and they continue to shrink as they continue to cool. The metal of the block 12B shrinks at a rate which is three times that of the carbide, and as the block 12B continues to shrink relative to the carbide, shear forces are applied to the rear surface of the carbide flange, and the metal of the block pulls axially away from the rear surface of the carbide applying tensile forces to the carbide as shown. The shear forces and the tensile forces weaken the tungsten carbide and render it more susceptible to fracturing when subjected to the impact stresses incurred when a machine cuts a hard surface.

Figure 5:
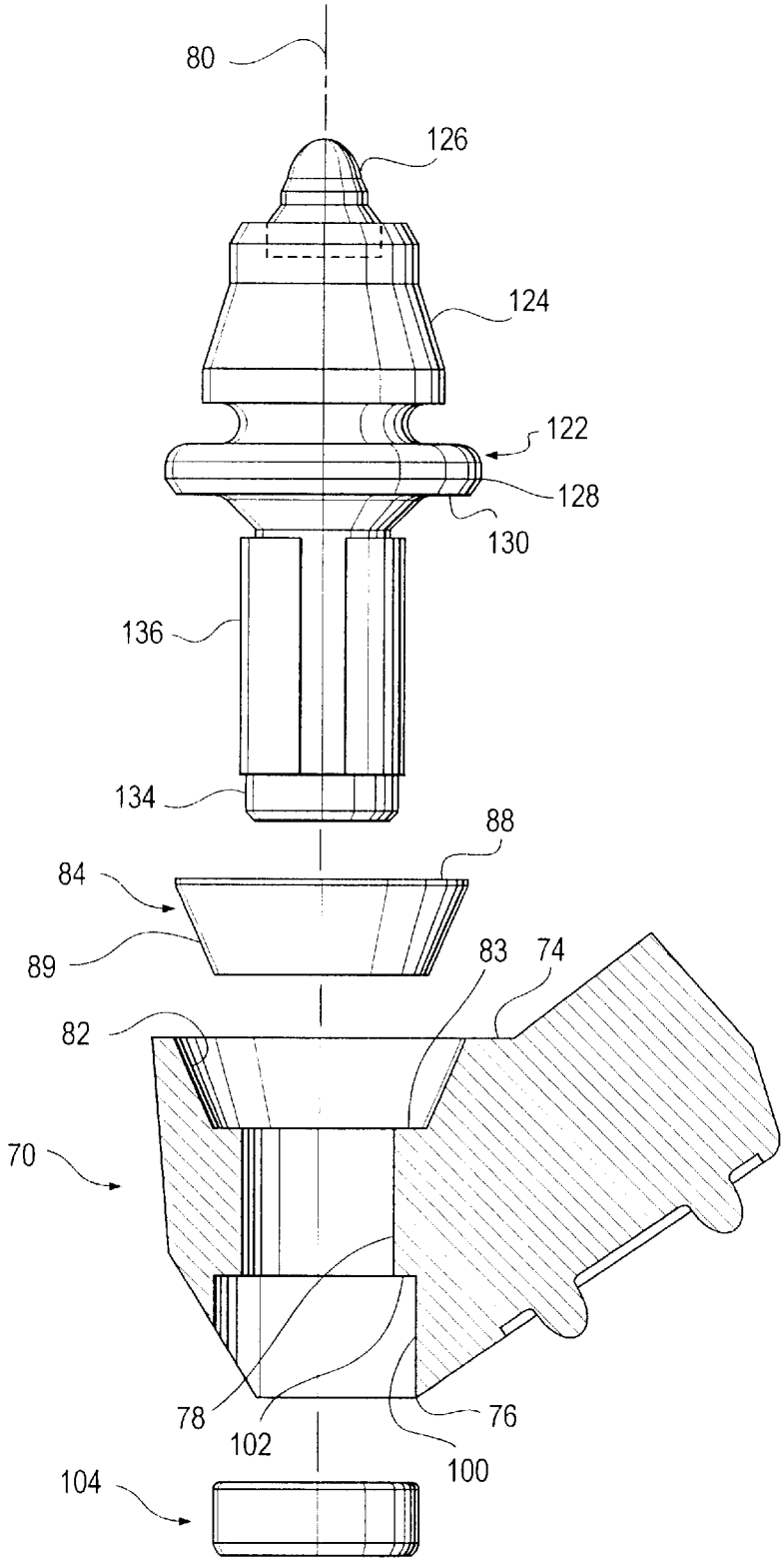
FIG. 5 is an exploded view of a tool mounting having inserts therein according to the present invention and having a tool mounted therein with the mounting block shown in cross section.
Figure 6:
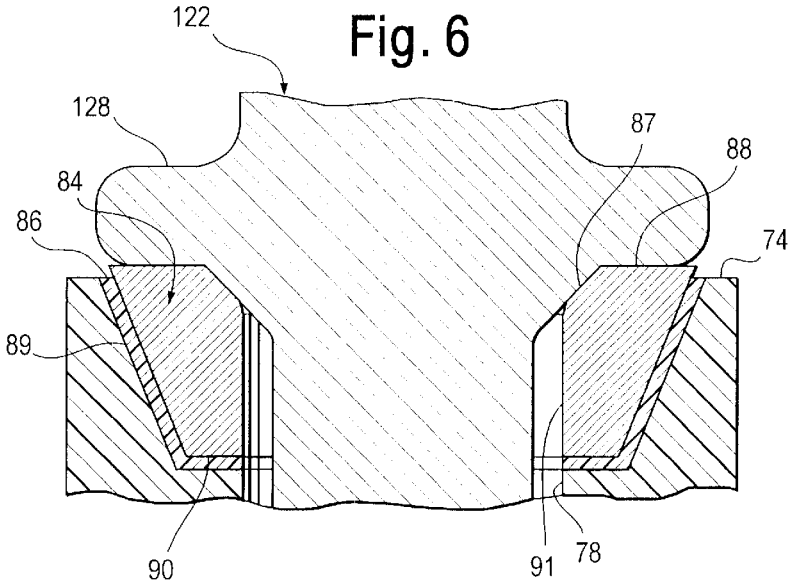
FIG. 6 is an enlarged fragmentary cross sectional view of the assembled forward insert in the mounting block shown in FIG. 5.

Referring to FIGS. 5 and 6, to overcome all of the above, a mounting block 70 in accordance with the present invention has a forward surface 74 and a rearward surface 76, and extending through the body of the block 70 is a cylindrical bore 78, the axis 80 of which is perpendicular to the forward surface 74. Around the opening of the bore 78 in the forward surface 74 is a frustoconical countersink 82 the inner wall of which has a ramp incline greater than a 10 degree angle from the axis 80, and having a bottom surface 83. The overall depth of the countersink 82 is less than one half the total length of the cylindrical bore 78. Fitted into the countersink 82 is a unitary annular insert 84, which in the preferred embodiment is made of tungsten carbide. The insert 84 is retained within the countersink 82 by a suitable attachment means such as a braze material 86.

Figure 7:
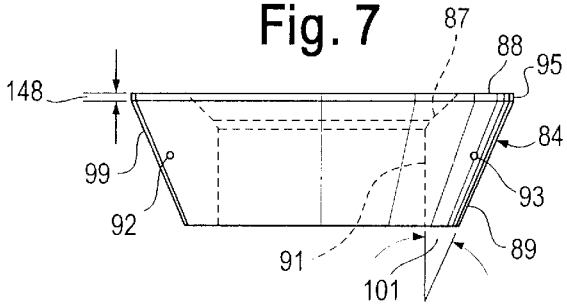
FIG. 7 is an enlarged side view of the forward insert shown in FIG. 5 with the inner portion thereof shown in phantom lines.
Figure 8:
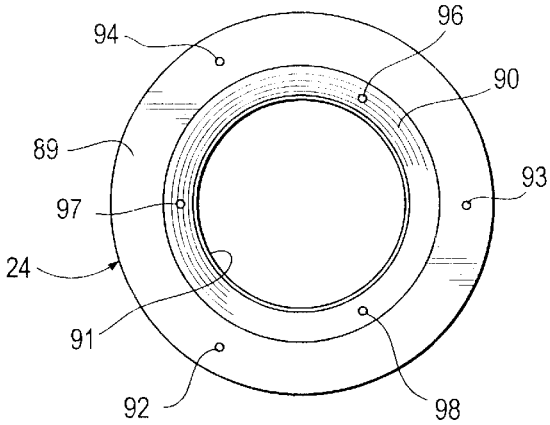
FIG. 8 is a bottom view of the insert shown in FIG. 7.

Referring to FIGS. 7 and 8, the annular insert 84 has a generally planar annular forward surface 88 which is forwardly offset approximately 1/16" from the forward surface 74 of the mounting block 70. The insert 84 further has a planar rearward surface 90 and a cylindrical inner wall 91 coaxial with axis 80 with a diameter which is substantially equal to the inner diameter of the bore 78 of the mounting block 70. A frustoconical taper 87 breaks the intersection between the forward surface 88 and the cylindrical inner wall 91.

Extending from the outer diameter of the forward surface 88 to the outer diameter of the rearward surface 90 is an outer wall 89 having a cylindrical forward portion 95 and a frustoconical portion 99 extending from the rear of the cylindrical portion 95 to the rearward surface 90. The cylindrical portion 95 has a length of about 1/16 inch and when the insert is mounted in the countersink of the mounting block 70, the 1/16 inch cylindrical portion 95 extends forward of the forward surface 74 of the block 70. The frustoconical portion 99 has a ramp angle 101 of approximately 24° and extends continuously through the length of the insert (with the exception of the cylindrical portion 95). The continuous frustoconical portion 99 is free of the abrupt transitions visible in the outer surfaces of both the sleeve 40 and the unitary piece 54 (as shown in FIGS. 3, 4 and 4A) because stresses within the tungsten carbide become concentrated around such transitions, and the concentration of the stresses can cause the insert to fracture.

A first plurality of bumps 92, 93, 94 are spaced around the outer surface 89 of the insert 84 and a second plurality of bumps 96, 97, 98 are spaced around the rearward surface 90 thereof. The bumps 92, 93, 94, 96, 97, 98 space the surfaces 89, 90 of the insert 84 from the surfaces 82, 83 of the mounting block 70 to permit braze material to flow therebetween. Preferably, the bumps will space the surfaces of the insert 84 a distance of from 0.004 to 0.012 inch from the surfaces of the block 70 to allow a liquefied braze material to flow between the parts. When the insert 84 is brazed within the countersink 82, the brazing material 86 binds to the insert 84 along the planar lower surface 90 of the insert and around the outer surface 89 thereof so that the insert 84 will be securely retained to the walls of the countersink 82 and the bottom surface 83.

The frustoconical surface 99 protects the braze 86 binding the insert 84 into the countersink 82 from the effects of wash away of the metal of the tool body 70, because wash away can expose only the portion of the circumference of the insert which is near the forward surface. If the surface 99 were cylindrical, the entire length of the cylindrical surface could be exposed as a result of wash away, and sides of the insert 84 would be subjected to being chipped away by chunks of hard material as has been previously loosened by the tool as has been previously described. The frustoconical surface 99 also provides a surface area which is larger than that of a cylindrical surface, and therefore more suitable for receiving the braze 86.

While prior efforts to provide a tungsten carbide wear ring for a cutting tool have all failed as result of fractures, the insert of the present invention has not failed even after more than one hundred tools or more have been inserted in the block and become worn out. I believe that the reason for the success of the present insert lies in the frustoconical surface 99 which is received in the frustoconical countersink 82 of block 70.

During the brazing of the insert 84 into the countersink 82, 83 in the block 70 the parts are heated in excess of 1800° F. to melt the braze material. Both the insert and the block expand during the heating, however, the metal of the block expands at 0.00000661 per unit length/° F. while the carbide expands at 0.00000239 per unit length/° F. After the parts are assembled together they are cooled, and as the temperatures fall below 1600° F. the braze material hardens. As the temperature continues to fall, the metal of the block shrinks at a rate which is three times that of the carbide.

Figure 7A:
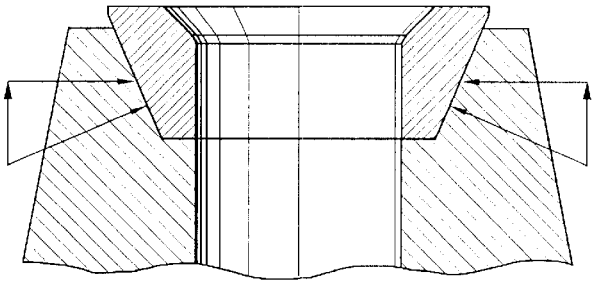
FIG. 7A is a cross sectional view of the insert shown in FIG. 7 showing compressive lines of force applied as a result of the brazing of the parts.

Referring to FIG. 7A, it can be seen that the forces applied to insert 84 as a result of the shrinking of the block 70 pre-stresses the carbide both radially and axially. It is believed that the compressive pre-stressing of the carbide with an axial component as shown permits the carbide to bear the impacts of the machine without shattering. It should be noted that it is the frustoconical surface 99 which causes the axial pre-stressing, and that a cylindrical outer surface of the insert, such as the tubular portion 56A shown in FIG. 4A would not create such a pre-stress.

Figure 9:
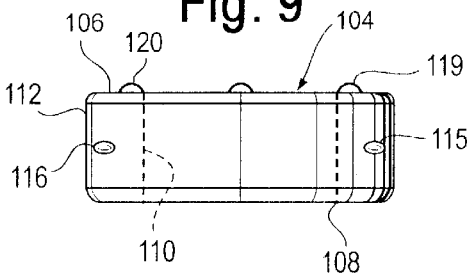
FIG. 9 is an enlarged side view of the second insert shown in FIG. 5 with the inner portion thereof shown in phantom lines.
Figure 10:
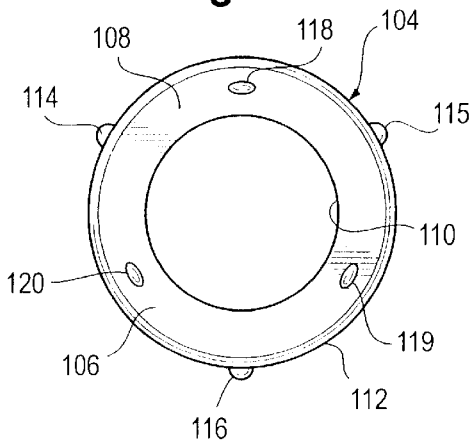
FIG. 10 is a bottom view of the insert shown in FIG. 9.

Referring to FIGS. 5, 9 and 10, around the opening of the bore 78 in rearward surface 76 is a counter bore with a cylindrical sidewall 100 and a planar inner surface 102, into which is fitted a second annular insert 104. The second insert 104 has a planar forward surface 106, a planar rearward surface 108, and cylindrical inner and outer walls 110, 112, respectively. The inner wall 110 has a diameter substantially equal to diameters of bore 78 of the block 70 and inner wall 91 of the insert 84. The outer wall 112 has a diameter which is a little less than the inner diameter of cylindrical side wall 100. The second insert 104 also has a first set of bumps 114, 115 116 spaced around the outer wall 112 thereof and a second set of bumps 118, 119, 120 spaced around the forward surface 106 thereof for spacing the wall 112 of the insert 104 from the wall 100 of the counter bore and the forward surface 106 of the insert 104 from the inner surface 102 for permitting a braze material to flow therebetween.

Fitted into the bore 78, 91 of the mounting block 70 and the insert 84 is a rotatable tool 122 having a generally tapered forward cutting end 124 which has a hardened tungsten carbide tip 126 at the forwardmost end thereof. Rearward of the forward cutting end 124 is a radial flange 128 having a rearward surface 130 which abuts against the forward surface 88 of the annular insert 84. The tool 122 is generally symmetric about the longitudinal axis 80 of the bore 78 and axially aligned behind the forward cutting end 124 and the radial flange 128 is a cylindrical mounting portion 134 having an axial length approximately equal to the axial length of the cylindrical aperture 78. The mounting portion 134 rotatably fits within the cylindrical openings 78, 91, 110 of the block 70 and the inserts 84, 104 and has a retention sleeve 136 around the circumference thereof to retain the mounting portion 134 within the bore 78 of the block 70.

The tool 122 is rotatable within the openings 78, 91, 110 of the block 70 and the annular inserts 84, 104 respectively, but the inner diameters of the bores 78, 91, 110 are only a little larger than the outer diameter of the mounting portion 134 such that even though the tool is rotatable within the bores 78, 91, 110 it is generally snugly retained by the sleeve 136 within the apertures so as not to wobble excessively. As can best be seen in FIG. 5, the force of the machine is applied through the mounting block 70 across the forward surface 88 of the annular insert 84 to the rearward surface 130 of the tool 122 and, therefore, strong forces are applied against the abutting surfaces 88, 130 of the annular insert 84 and tool 122, respectively.

As shown in FIGS. 5 and 7, the forward surface 88 of the insert 84 is forwardly offset from the forward surface 74 of the mounting block 70 a distance 148 which preferably is about 1/16 inch. This forward offset of the insert 84 prevents the steel of the block 70 from contacting the rear surface 130 of the flange 128 and prevents excessive friction between these parts.

In prior art tools and mountings, particles of hardened material which worked between the abutting surfaces of the tool and the mounting block and around the inner surface of the bore within the block caused the forward surface of the block to become worn and caused the bore of the block to become enlarged and no longer cylindrical. As a result of such wear, when the original tool was discarded and a replacement tool inserted into such prior art blocks, the damage to the forward surface thereof inhibited the rotation of the replacement tool. Similarly, because of the damage to the inner surfaces of the bore thereof, the mounting portion of the replacement tool would not fit properly within the bore allowing the replacement tool to wobble within the mounting. The wobbling of the replacement tool within its mounting inhibits its inability to freely rotate within the mounting and causes the rapid deterioration of the replacement tool.

When the tool 122 is fitted into mounting block 70, the forward end of the mounting portion 134 of the tool 122 rotates within the cylindrical opening 91 of the first insert 84 and the rearward end of the mounting portion 134 rotates within the cylindrical opening 110 of the second insert 104. These surfaces protect the inner surface of the bore 78 from becoming damaged as occurred with prior art mounting blocks.

A mounting block 70 in accordance with the present invention will not be subjected to as much wear from particles of hardened material which work their way between the surfaces 88, 130 of the annular insert 84 and the tool 122 as did prior art blocks because the tungsten carbide inserts are much harder than the steel of the tool body 122. The hard particles will of course cause damage to the rearward surface 130 of the tool 122 and to the mounting portion 134 of the tool, but will cause very little damage to the forward surface 88 of the insert 84 or the cylindrical apertures 91, 110 of the inserts 84, 104. A replacement tool 122 will be snugly retained within the cylindrical apertures 91, 110 of the annular inserts 84, 104 and the forward surface 88 of the annular insert 84 will remain substantially smooth and maintain its size so as to readily permit rotation of the replacement tool 122.

In addition to increasing the overall life of the mounting block 70, the hardened forward surface 88 of the insert 84 has a lower coefficient of friction than the steel of the forward surfaces of prior art mounting blocks. The insert 84, therefore, also acts as an improved bearing surface to facilitate rotation of the tool 122.

Figure 11:
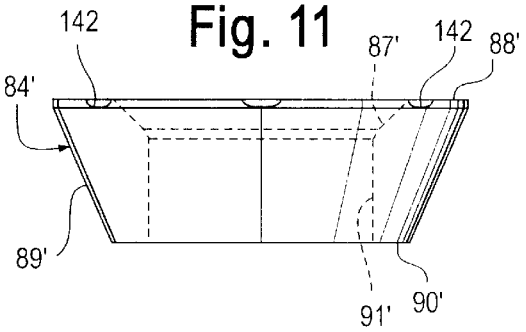
FIG. 11 is an enlarged side view of a second embodiment of the forward insert.
Figure 12:
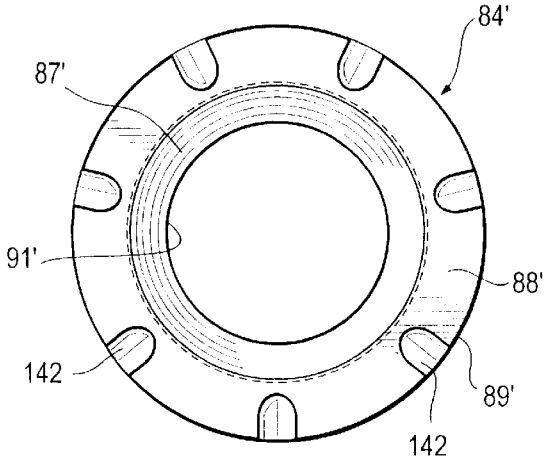
FIG. 12 is a top view of the insert shown in FIG. 11.

Referring to FIGS. 11 and 12, a second embodiment of an insert 84' is similar to the first embodiment, and like portions bear like indicia numbers except that they are primed. Specifically, insert 84' has a planar forward surface 88', a frustoconical outer surface 89', a planar rear surface 90', a cylindrical inner wall 91', and a taper 87' joining the forward surface 88' to the inner wall 91'. In addition to the above, insert 84' has a plurality of spaced radially directed grooves 142—142 in the forward surface 88' with each groove 142 extending to the outer surface 89' but not extending to the tapered surface 87'.

The grooves 142—142 provide clean out channels into which particles of material which work between the forward surface 88' and the rearward surface 130 of the flange 128 will be ejected out as the tool 122 rotates within the mounting block 70. The grooves 142—142 also reduce the surface area of surface 88', thereby reducing the friction between the forward surface 88' and the rearward surface 130, and thereby facilitate rotation of the tool 122.

Figure 13:
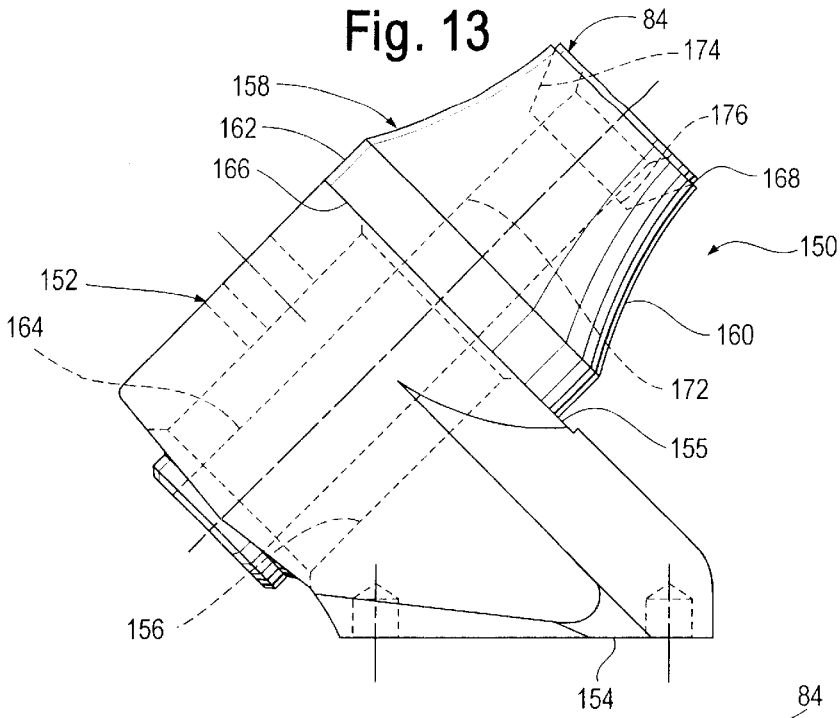
FIG. 13 is a side elevational view of a mounting block and tool holder in accordance with another embodiment of the invention.
Figure 14:
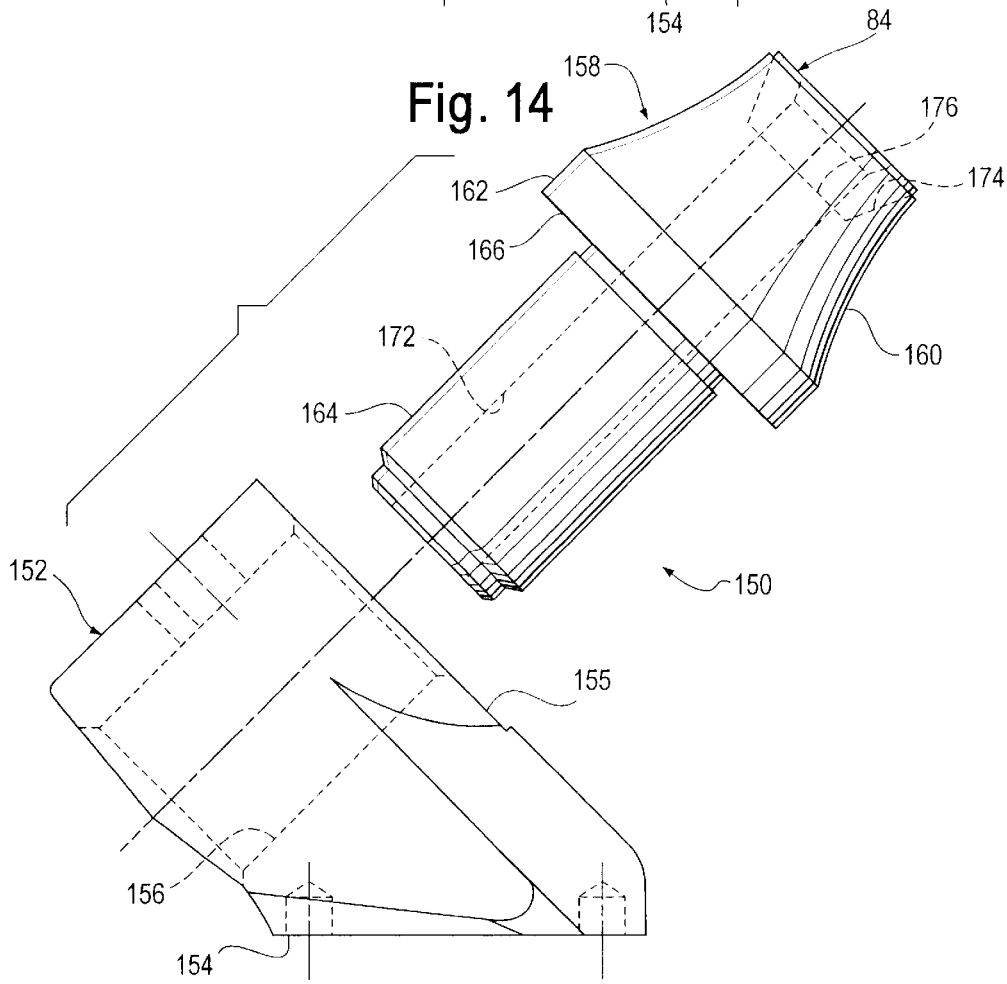
FIG. 14 is an exploded side elevational view of the bock and tool holder shown in FIG. 13.

Referring to FIGS. 13 and 14 in which another embodiment of a tool assembly 150 embodying the present invention is depicted. In this embodiment a block body 152 has a mounting portion 154 for attachment to a machine (not shown), a forward surface 155, and a transverse bore 156. Fitted into the bore 156 is an elongate tool holder 158 having a tapered forward end 160 which diverges to a cylindrical mid-section 162. Axially behind the cylindrical mid-section 162 is a cylindrical mounting portion 164 having a diameter which is nearly equal to the inner diameter of the bore 156 so as to snuggly fit therein. The diameter of the mounting portion 164 is substantially less than the diameter of the mid-section 162 thereby forming a radial shoulder 166 therewith which contacts the forward surface 155 when the two parts are assembled together as shown in FIG. 13.

Extending from the forward end 168 to the rearward end of the tool holder 158, and axially through the length thereof is a bore 172, and around the forward end 168 of the bore 172 is a countersink having a frustoconical side wall 174 and a planar annular bottom surface 176. The side wall 174 is complementary in shape to the frustoconical portion 99 of the insert 84. Also the rearward portion of the bore 172 has a diameter substantially equal to the diameter of the cylindrical inner wall 91 of the insert 84.

In accordance with this embodiment of the invention, an insert 84 as described with respect to FIGS. 6, 7, and 8 is brazed to the wall 174 and bottom surface 176 of the countersink. Thereafter the shank 134 of a tool 122 having a retention sleeve 136 thereon as described with respect to FIG. 5 is fitted into the bores 91, 172. The thrust forces incurred as the tool 122 cuts into a hard surface are applied across the forward surface 88 of the insert 84 and the rear surface 130 of the radial flange 128 of the tool 122.

In this embodiment, the tool 122 rotates within the bore 172 of the tool holder 158, and the insert 84 protects the bore 172 of the tool holder 158 against wear. The insert 84 also provides a bearing surface on which the flange 128 of the tool can rotate and will not wear away even after one hundred tools have been successively inserted into the tool holder 158 and become worn away.

While several embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A tool retainer for receiving a tool having a radial flange with a first given diameter and a cylindrical mounting portion, said tool retainer comprising, a retainer body having a forward surface, said retainer body being attachable to a machine, said retainer body having a cylindrical aperture therein, said cylindrical aperture opening in said forward surface, said cylindrical aperture having an axis and an axial length, said forward surface having a countersink around said cylindrical aperture, said countersink having an axial length less than half said axial length of said cylindrical aperture and having an annular inner surface, said countersink having a rear surface extending radially outward from said cylindrical aperture to said annular inner surface, said inner surface continuously diverging from said rear surface to said forward surface and having a rate of incline without interruption of at least 10 degrees from said rear surface to said forward surface, a unitary annular insert in said countersink, said unitary annular insert having a cylindrical central opening axially aligned with said axis of said cylindrical aperture of said retainer body, an outer surface complementary to said inner surface of said countersink, and a rear surface complementary to said rear surface of said countersink, said unitary annular insert made of tungsten carbide, and brazing material between said retainer body and said unitary annular insert for attaching said unitary annular insert within said countersink of said retainer body.

2. A tool mounting in accordance with claim 1 and wherein said cylindrical aperture extends through said retainer body.

3. A tool retainer in accordance with claim 1 wherein said retainer body is a tool holder having a forward end and behind said forward end is a cylindrical mounting portion, said cylindrical aperture extending axially through said forward end and through said cylindrical mounting portion, and a mounting block having a mounting portion for attachment to a machine and a cylindrical bore, and said cylindrical mounting portion of said retainer body fitted in said cylindrical bore of said mounting block.

4. A tool retainer in accordance with claim 3 and further comprising spacing means between said retainer body and said insert for spacing said insert from said retainer body for receiving said brazing material therebetween.

5. A tool retainer in accordance with claim 1 wherein said retainer body is a mounting block having a mounting portion for attachment to a machine.

6. A tool retainer in accordance with claim 1 where said insert has a forward surface and said forward surface of said insert is forwardly offset with respect to said forward surface of said retainer body.

7. A tool retainer in accordance with claim 1 and further comprising, said retainer body having a rearward surface and said cylindrical aperture opening in said rearward surface, said rearward surface having a counterbore around said cylindrical aperture, an annular insert fitted in said counterbore around said cylindrical aperture in said rearward surface, said annular insert having a central opening axially aligned with said axis of said cylindrical aperture of said retainer body, said annular insert made of tungsten carbide, and braze material between said retainer body and said annular insert.

8. A tool retainer for receiving a rotatable tool having a forward cutting end, a radial flange axially behind said forward cutting end, and a cylindrical mounting portion axially behind said radial flange, said tool retainer comprising a forward end, a rearwardly facing annular shoulder behind said forward end and, axially aligned behind said annular shoulder, an elongate mounting portion retainable in a bore of a holder for holding said tool retainer to a machine, a portion of said forward end having a taper thereto, said forward end having a forward surface and a side surface joining said forward surface along an edge, said tool retainer having a cylindrical aperture therein for rotatably receiving said cylindrical mounting portion of said rotatable tool, said cylindrical aperture extending through said forward end and into said elongate mounting portion, said cylindrical aperture opening in said forward surface, said cylindrical aperture having an axis perpendicular to a plane of said forward surface, and said forward surface having at least one groove therein, said groove extending radially outward through said forward surface to said side surface of said tool retainer.

* * * * *